US010214982B2

(12) United States Patent
Telfer

(10) Patent No.: US 10,214,982 B2
(45) Date of Patent: Feb. 26, 2019

(54) RETRIEVABLE SUBSEA DEVICE AND METHOD

(75) Inventor: George Telfer, Aberdeenshire (GB)

(73) Assignee: M-I Drilling Fluids UK Limited, Aberdeen (GB)

( * ) Notice: Subject to any disclaimer, the term of this patent is extended or adjusted under 35 U.S.C. 154(b) by 286 days.

(21) Appl. No.: 13/808,049

(22) PCT Filed: Jul. 1, 2011

(86) PCT No.: PCT/GB2011/051251
§ 371 (c)(1),
(2), (4) Date: Mar. 22, 2013

(87) PCT Pub. No.: WO2012/001426
PCT Pub. Date: Jan. 5, 2012

(65) Prior Publication Data

US 2013/0175044 A1 Jul. 11, 2013

(30) Foreign Application Priority Data

Jul. 2, 2010 (GB) ..... 1011153.2

(51) Int. Cl.
*E21B 29/02* (2006.01)
*E21B 29/00* (2006.01)
(Continued)

(52) U.S. Cl.
CPC ..... *E21B 29/002* (2013.01); *E21B 17/1007* (2013.01); *E21B 33/06* (2013.01); *E21B 33/062* (2013.01); *E21B 33/068* (2013.01)

(58) Field of Classification Search
CPC ..... E21B 17/10; E21B 17/1007
(Continued)

(56) References Cited

U.S. PATENT DOCUMENTS 4,076,079 A 2/1978 Herricks et al.
6,003,602 A 12/1999 Wilkins
(Continued)

FOREIGN PATENT DOCUMENTS

GB 940758 A 10/1963
WO 2006103477 A1 10/2006
WO WO 2006103477 A1 * 10/2006

OTHER PUBLICATIONS

International Search Report for PCT Application Serial No. PCT/GB2011/051251 dated Nov. 27, 2011.

*Primary Examiner* — Anna M Momper
*Assistant Examiner* — Patrick F Lambe
(74) *Attorney, Agent, or Firm* — Paula B. Whitten

(57) ABSTRACT

A protective device for a blow out preventer stack (B.O.P.), and a sidetracking method using same during an oil-field milling or drilling operation requiring a window to be formed in casing to access a formation, the device having a sleeve assembly and a running tool releasably attached to the sleeve assembly, wherein the running tool comprises a running tool housing connected to the sleeve assembly and a separable running tool body connectable within the length of a work string having a BHA with a mill or bit, the running tool housing being shear pinned to the running tool body for running in hole, wherein the running tool housing is configured to shear from the running tool body during deployment into a cased wellbore to sealingly seat the sleeve assembly within a B.O.P. and form a barrier to ingress of swarf into the B.O.P.

7 Claims, 2 Drawing Sheets

(51) Int. Cl.
*E21B 17/10* (2006.01)
*E21B 33/06* (2006.01)
*E21B 33/068* (2006.01)

(58) Field of Classification Search
USPC ..... 166/297, 298, 55, 385
See application file for complete search history.

(56) References Cited

U.S. PATENT DOCUMENTS

| | | | | |
|---|---|---|---|---|
| 6,289,993 | B1 | 9/2001 | Murray | |
| 6,626,245 | B1 | 9/2003 | Murray | |
| 2004/0118614 | A1* | 6/2004 | Galloway et al. ..... | 175/381 |
| 2007/0107910 | A1* | 5/2007 | McGuire et al. ..... | 166/379 |

* cited by examiner

RETRIEVABLE SUBSEA DEVICE AND METHOD

FIELD OF THE INVENTION

The present invention relates to a device deployable upon a workstring during a downhole operation and retrievable with the workstring upon completion of the downhole operation, and especially to a device useful during a milling operation typically required within casing for the purposes of preparing a well for oil and gas production.

BACKGROUND TO THE INVENTION

When drilling for oil and gas, a wellbore or borehole of an oil or gas well is typically drilled from surface to a first depth and lined with a steel casing. The casing is located in the wellbore extending from a wellhead provided at surface or seabed level, and is then cemented in place. Following testing and other downhole procedures, the borehole is extended to a second depth and a further section of smaller diameter casing is installed and cemented in place. This process is repeated as necessary until the borehole has been extended to a location where it intersects a producing formation. In some cases, a final section of tubing known as a liner may be located in the wellbore, extending from the lowermost casing section or casing 'shoe' to the producing formation, and is also cemented in place.

In order to access oil or gas containing formation outside the casing, the casing may be perforated at a selected zone by means of explosives. The perforated casing optionally may be opened up further by appropriate tooling to form an enlarged hole or slot referred to as a "window" in the art. Alternatively, a milling tool may be used for the purpose of removing a substantial section of casing to provide a window to permit drilling of a side track through the casing to provide access to another region of formation or to effect a by-pass or deviated wellbore. Such a milling operation results in large amounts of swarf which has to be circulated out. Similarly where a milling operation is required to remove a broken or stuck pipe or tool or any other junk that is obstructing normal operations, large amounts of metallic swarf have to be recovered.

Where relatively smooth bore casing or liner defines the outer surface of the annulus around the drill string the return of metal swarf can be achieved and the recovery of such metal swarf may be enhanced by use of magnetic tool elements incorporated in the string.

However, when circulation of such swarf-laden fluids is to pass through a blow out preventer (B.O.P.) which has cavities or recesses housing contingency equipment, passages allowing an intervention or coupling of ancillary equipment, a potential risk factor is realised in that each cavity, recess or passage represents a trap for metallic swarf debris. Where the metallic swarf fouls in such cavities, recesses and passages, the consequences may be that operational use of contingency measures can be compromised. In particular concerns arise in relation to the integrity of the sealing surfaces of the B.O.P. rams. It will be understood that such risks arise at any point in the fluid circulation path and could impact on B.O.P. performance whether it is located at the wellhead on the seabed or at surface e.g. below the drill floor. However such risks are exacerbated when the B.O.P. is located at depth, i.e. at the wellhead on the sea floor, where access is restricted and there is a high dependency on reliability of the contingency measures provided thereby.

The B.O.P. is a critical contingency measure for regaining control of wellbore pressure when it exceeds controlled circulation fluid pressure and a high degree of confidence is required that it will operate when required without failure.

Currently, some operators prefer to avoid the considerable risk associated with such a fouling of the B.O.P. by retrieving the B.O.P. after such a milling operation to conduct an inspection. When the B.O.P. is recovered to surface for such an inspection, and then subsequently re-deployed it is not unusual to lose from 1 to 2 days in turn around. The time involved in recovery inspection, and re-running of the subsea B.O.P. to the wellhead for re-installation leads to a high cost which currently appears unavoidable to a prudent operator.

However, cost is not the dominating factor, and the decision to pull the riser and subsea B.O.P. stack is not one to be taken lightly in view of the considerable HSE risks associated with completing the operation. It will be understood that the stack is an assembly of contingency measures weighing several hundred tons, that a deep water marine riser also weighs several hundred tons and that the controlling vessel typically has to take account of dynamic loadings and risks to failure of joints and seals in the combined lift package. Handling of the retrieved B.O.P. and riser components involves additional risks to personnel. Therefore, there are numerous HSE risks associated with these heavy lifting operations.

SUMMARY OF THE INVENTION

The present invention provides apparatus and a method which allows internal protection of a blow out preventer (B.O.P.) especially a subsea B.O.P. at the wellhead, against deleterious ingress of metallic swarf during circulation thereby minimising the risk of fouling leading to compromise of the equipment.

The invention to be more particularly described herein provides a protective device for a blow out preventer stack (B.O.P.), and a sidetracking method using same during an oilfield milling or drilling operation requiring a window to be formed in casing to access a formation. The protective device has a sleeve assembly and a running tool releasably attached to the sleeve assembly. The running tool may comprise a running tool housing connected to the sleeve assembly and a separable running tool body connectable within the length of a work string. The work string may have a BHA with a mill or bit. The running tool housing may be shear pinned to the running tool body for running in hole, and configured to shear from the running tool body during deployment into a cased wellbore to sealingly seat the sleeve assembly within a B.O.P. and form a barrier to ingress of swarf into the B.O.P.

According to the present invention there is provided a method of protecting a blow out preventer (B.O.P.), comprising providing a protective device adapted for deployment on a work string into the bore of the B.O.P. from which it is subsequently retrievable. The device may comprise an outer releasable sleeve assembly and a running tool, wherein the running tool is connectable into a work string and the outer releasable sleeve assembly is connected to the running tool by releasable fasteners for running in hole, typically shear pins designed to yield at a predetermined string set down weight. The running tool may be configured to land on a surface within a subsea structure to effect release of the fasteners and deploy the releasable sleeve assembly within the B.O.P. The sleeve assembly is configured to define a fluid circulation path around the workstring within the B.O.P. and form a barrier to ingress of deleterious materials into cavities of the B.O.P.

The protective device is connected into a work string for run in and is typically within the length of work string and may be spaced from a bottom hole assembly (BHA) including for example a milling tool or drill bit. The work string may be made up for example from drill pipe using standard pin and box joints, and the protective device may be connected into the work string during the usual make up procedure and positioned at a predetermined distance from the BHA for subsequent deployment within the B.O.P. In this way the probability of metallic swarf circulating upwards from a milling tool and becoming trapped in a critical section of the B.O.P. stack, e.g. a cavity including a sealing surface within the B.O.P. is greatly diminished. The sleeve acts as a bridging conduit for return of swarf-contaminated circulation fluid to allow it to bypass the critical components within the B.O.P.

The landing surface within the wellhead structure may be a shoulder or other stable surface therein, and typically advantage will be taken of the presence of the wear bushing located below the B.O.P. as a landing surface.

The releasable sleeve assembly may comprise a sleeve formed from a casing pipe dimensioned to define an annulus around a work string or drill string upon which the device is mounted, and a body including an outer flexible seal to inhibit swarf by-passing the device. The sleeve may be mounted between a leading head assembly including the running tool and the trailing assembly including the body and flexible seal.

The sleeve may be formed from any material capable of meeting performance criteria with regard to wear resistance, strength and pressure integrity, and may be of a metallic or composite material.

The leading head assembly is typically threadably connected to a first end of the sleeve and may comprise a running tool housing to which the running tool is releasably fastened, wherein the housing or the running tool may be configured to provide at least one fluid pathway in the form of channels or passages to permit circulation of fluid through the annulus around the work string.

The body of the trailing assembly is typically threadably connected to a second end of the sleeve and is configured to provide at least one fluid pathway in the form of channels or passages to permit circulation of fluid through the annulus around the work string.

The leading head assembly preferably comprises a running tool attachable to a string and a running tool housing attached to the sleeve. The running tool is releasably attached within the running tool housing preferably by use of shear fasteners designed to yield at a particular weight loading. The running tool housing is configured to provide landing surfaces for engaging a surface within the wellhead structure e.g. the wear bushing below the B.O.P.

In this way when the fasteners are sheared by setting down weight on the string after landing of the running tool housing on a surface to effect shearing of the releasable fastener pins, the running tool is freed to run further in hole upon the string leaving the B.O.P. lined and protected against ingress of deleterious amounts of swarf or debris circulated up from any downhole operation. After landing of the device, the string can be operated as usual to run on in and conduct any task required using any tool deployed upon the string. Typically this will be a milling operation, but the work string could equally be fitted with a BHA for drilling in which case the string would be a drill string. A combination of tools to effect both penetration of the casing to open up a sidetrack and also allow a "drill ahead" operation in the same trip (without pulling the work string) may be used.

Where a "drill ahead" operation is conducted immediately after milling out a window in the casing (without pulling out the string first) the running tool may be carried several hundred feet beyond the window and thereby be remote from the B.O.P. In order to anticipate development of a situation where it is deemed necessary to apply a contingency measure requiring the B.O.P. to be fully operational, the work string can be modified to allow retrieval of the protective device of this invention before the running tool or pick up sub can be pulled back to the B.O.P. A suitable modification would be to introduce an auxiliary pick up device that can latch onto the protective device of this invention and allow it to be pulled out of the B.O.P. a sufficient distance to allow any or all of the B.O.P. contingency measures to be operated. This precautionary modification is achievable before run in by introducing a collet at intervals in the make up of the work string behind the running tool/protective device assembly. A series of such auxiliary pick up devices could be conveniently spaced out at intervals of 90 feet or less. It will be understood that on run in the auxiliary pick up devices are stowed but on pull out in an emergency situation, at least one of such pick up devices is deployed, optionally automatically e.g. by contact with a surface of the protective device itself or a surface near to it thereby effecting release of stored energy biasing means, such as by spring loading to allow pulling of the protective device out of the B.O.P. sufficiently. This means that by pulling the work string a relatively short distance the protective device is cleared from the B.O.P. sufficiently to allow full operation thereof without need to pull the work string the full distance required to recover the remote running tool to the B.O.P.

When the B.O.P. is to be protected by the device of the invention, the preferred operational use of the device of the invention in conjunction with the B.O.P. is to close an annular seal of the B.O.P. upon the sleeve of the device to hold position thereof.

When the downhole operation is completed and the string is being pulled out of the hole, the running tool re-engages the running tool housing and picks up the sleeve assembly device for retrieval to surface on the string. The B.O.P. annular seal(s) would be opened to allow clear passage to recover the string, device and tools/BHA.

In an embodiment of the invention there is provided a method of accessing an oil or gas containing formation by forming a window in the casing of a cased wellbore to permit sidetrack entry to the formation, the method comprising deploying a tool assembly upon a work string via a blow out preventer stack (B.O.P.) and through a wellhead into the casing, said tool assembly comprising a milling and/or drilling tool adapted to penetrate the casing and a B.O.P. protection device comprising a releasable sleeve assembly and a running tool for same, wherein the running tool comprises a running tool housing connected to the releasable sleeve assembly and a separable running tool body connected into the work string within its length, the running tool housing being connected to the running tool body by releasable fasteners for running in hole, and wherein the running tool housing is configured to land on a surface within a subsea wellhead structure, landing the running tool to effect release of the fasteners and separation of the running tool housing from running tool body to deploy the releasable sleeve assembly within the B.O.P.

wherein a sleeve of said releasable sleeve assembly is configured to define a fluid circulation path around the work string within the B.O.P., and form a barrier to ingress of deleterious materials into the B.O.P.

running the milling and/or drilling tool on downhole within the casing and milling a window in the casing and optionally drilling into the formation.

Preferably, the B.O.P. protection device is dimensioned and positioned to locate the releasable sleeve assembly between seals and rams forming contingency measures of the B.O.P and an annular seal of the blow out preventer is sealingly closed upon the releasable sleeve assembly to hold position thereof.

The invention further provides a work string comprising a milling and/or drilling tool and a blow out preventer stack (B.O.P.) protection device comprising a releasable sleeve assembly and a running tool for same, wherein the running tool comprises a running tool housing connected to the releasable sleeve assembly and a separable running tool body connected into the work string within its length, the running tool housing being connected to the running tool body by releasable fasteners for running in hole, wherein the running tool housing is configured to land and seal upon a surface within a subsea wellhead structure, and wherein the sleeve of said sleeve assembly is dimensioned to define an annulus around the work string.

The releasable sleeve assembly provided for the purposes of any aspect of the invention may comprise a sleeve mounted between a leading head assembly connected to a first end of the sleeve and including the running tool housing to which the running tool is releasably fastened, and a trailing assembly comprising a body connected to a second end of the sleeve and including an outer flexible seal to inhibit swarf by-passing the device in use, wherein both the leading head assembly and trailing assembly are provided with at least one fluid pathway in the form of channels or passages to permit circulation of fluid through the annulus around the work string. Assembly may be achieved using correspondingly threaded parts.

An embodiment of the work string of the invention may comprise at least one auxiliary pick up device in a position spaced from the running tool sufficiently that in the event of a requirement for operation of any or all of the B.O.P. contingency measures the said at least one auxiliary pick up device can be deployed to latch onto the sleeve assembly to recover same from the B.O.P by pulling the work string a shorter distance than that required to recover the running tool to the protective sleeve assembly.

Such an auxiliary pick up device may comprise stored energy biasing means to facilitate automatic deployment.

It may be preferred e.g. when drilling ahead some distance into a sidetrack to include a series of auxiliary pick up devices spaced out at intervals upon the work string.

A suitable auxiliary pick up device may comprise a collet.

A blow out preventer stack (B.O.P.) protection device, suitable for subsea use, comprises a sleeve assembly and a running tool releasably attached to the sleeve assembly, wherein the running tool comprises a running tool housing connected to the sleeve assembly and a separable running tool body connectable within the length of a work string, e.g. by mounting the running tool body to a drill pipe having traditional pin and box tool joint parts, the running tool housing being connected to the running tool body by shear fastener pins for running in hole, wherein the running tool housing is configured to shear the fastener pins by contact with an external surface during deployment into a cased wellbore, and wherein the sleeve of said sleeve assembly is dimensioned to define an annulus around the work string when deployed within a B.O.P. and form a barrier to ingress of deleterious materials into the B.O.P.

The releasable sleeve assembly may comprise a sleeve mounted between a leading head assembly connected to a first end of the sleeve and including the running tool housing to which the running tool is releasably fastened, and a trailing assembly comprising a body connected to a second end of the sleeve and including an outer flexible seal to inhibit swarf by-passing the device in use, wherein both the leading head assembly and trailing assembly are provided with at least one fluid pathway in the form of channels or passages to permit circulation of fluid through the annulus around the work string.

DESCRIPTION OF THE DRAWINGS

In the accompanying figures.

DESCRIPTION OF AN EMBODIMENT OF THE INVENTION

An embodiment of the protective sleeve device of the invention is illustrated in the accompanying figures and shown deployed upon a workstring within a blow out preventer stack (B.O.P.).

Figure 1:
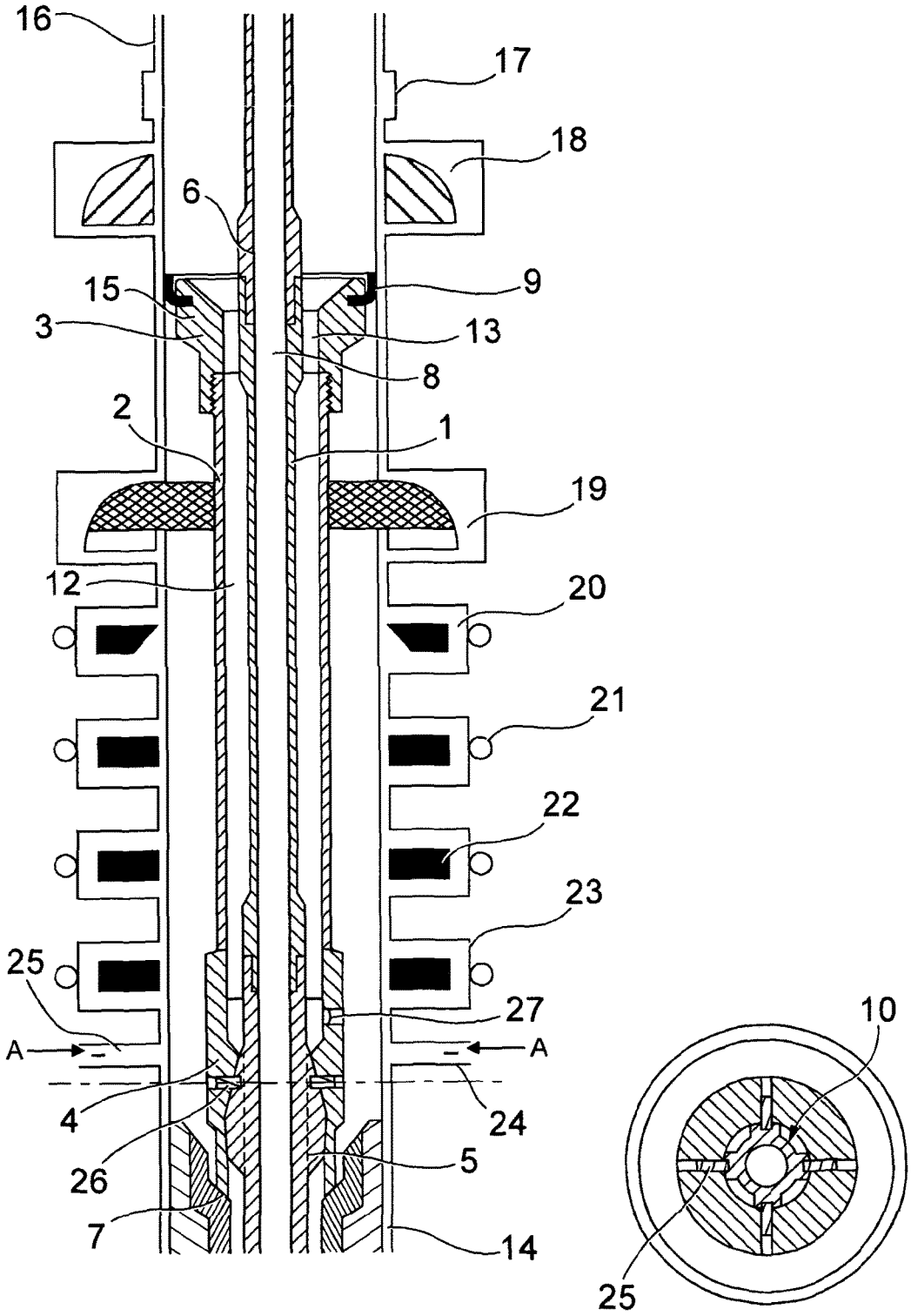
FIG. 1 illustrates a longitudinal section through a workstring bearing a device of the invention located within a B.O.P.; and inset a cross-sectional view A-A through the running tool of the device.

Referring to FIG. 1, the device comprises a hollow drill pipe or mandrel 1, the mandrel having an axial passage 8 for the passage of drilling fluid, and being connected at an upper end to a drill pipe 6 forming part of a work string in the usual way using pin and box threaded connections. A running tool 5 is connected to the lower part of the mandrel 1 and that in turn is also connected to further drill pipe sections forming the drill string (not shown in FIG. 1) below the device.

A running tool housing 4 attached to the running tool 5 by shear fastener pins 26 also provides a means of attachment for a protector sleeve 2 spaced from the mandrel 1 to define an annulus 12 within the device to allow fluid flow communication with wellbore annulus above and below the device. The upper end of the protector sleeve 2 is attached to a top assembly 3 including a body 15 with a flared inlet and a peripheral flexible sealing element 9.

The running tool housing 4 is configured to provide a leading profile adapted to sealingly engage a surface within a subsea wellhead structure around or within the wellbore upon which weight can be borne to a level at which the shear fastener pins 26 will yield. A suitable surface is typically found on the wear bushing 7 below the B.O.P. stack and the running tool housing profile will be designed accordingly. One or more chamfered edges may provide a suitable surface for sealingly engaging corresponding surfaces on the wear bushing 7. Other suitable weight bearing surfaces could be selected.

The running tool is also configured to form generous fluid by-pass channels 10 (see inset section A-A detail of FIG. 1) to permit fluid by-pass through the running tool housing and allow fluid communication between the annulus around the drill string below the device and for returns of fluid borne swarf through the annulus 12 within the protector sleeve 2, and out via passage 13 within the top assembly 3 to the riser 16.

The device of the invention is shown deployed within a B.O.P. stack attached to conductor casing 14, and to which a marine riser 16 is coupled via flex joint 17 the riser being connected as usual to a surface vessel or rig (not shown).

The B.O.P. is of typical construction and includes (progressing from top of stack to bottom) an upper annular seal 18, a lower annular seal 19 (shown closed upon the protector sleeve 2), and a succession of radially deployable rams namely, drill pipe shear rams 20, upper pipe rams 21, middle pipe rams 22 and lower pipe rams 23.

Kill line 24 and choke line 25 are shown at the bottom of the stack. A bursting disc 27 is located in the running tool housing 4 to provide for fluid communication between an annulus around the running tool housing 4 and the annulus 12 within the sleeve assembly 2 while the sleeve assembly 2 remains in an operational position.

Figure 2:
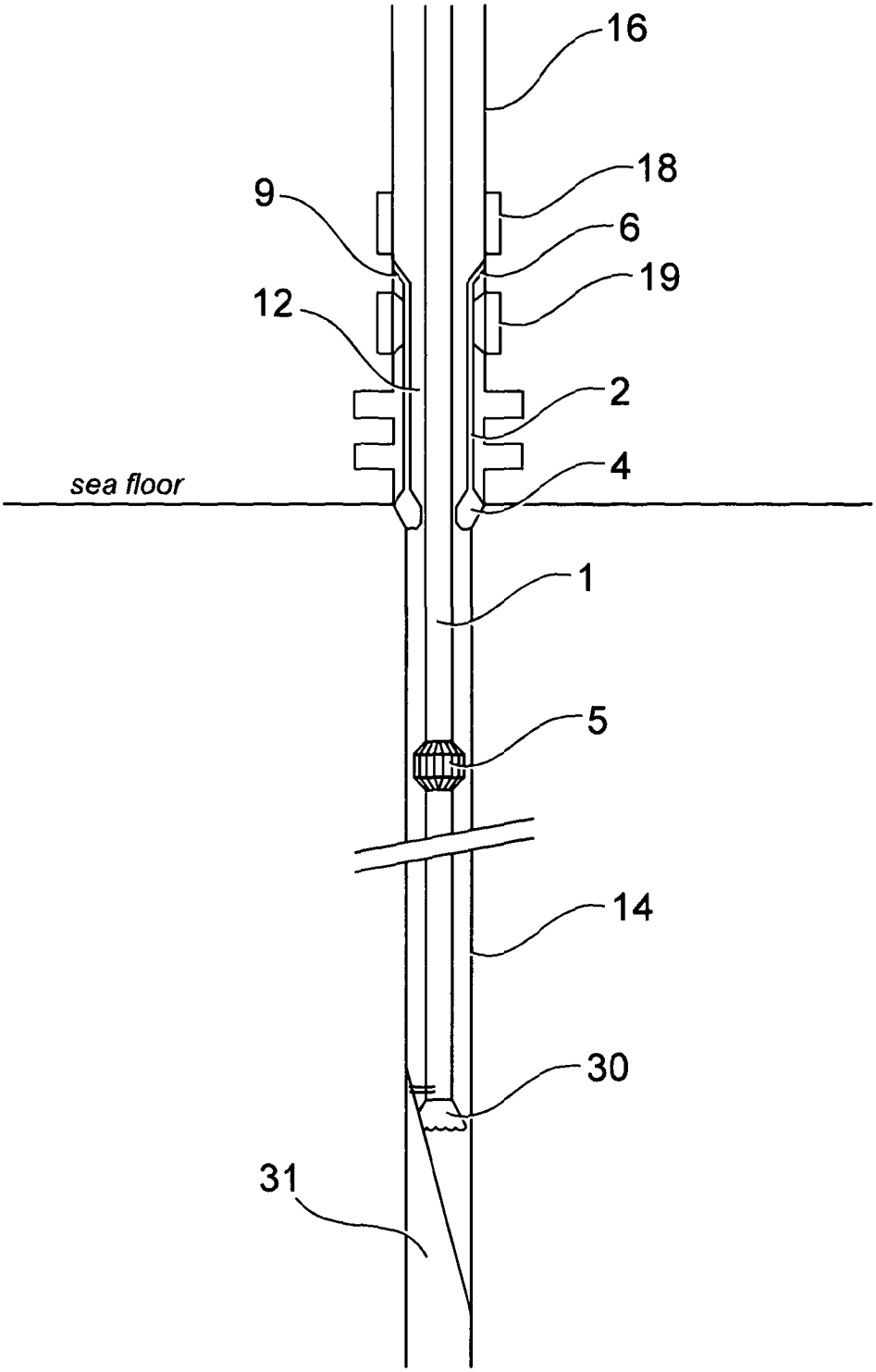
FIG. 2 illustrates a workstring with B.O.P. protector sleeve assembly deployed in the B.O.P. and the BHA run through below the wellhead to the site for sidetrack access through the casing.

FIG. 2 shows a typical deployment of the protective sleeve assembly comprising sleeve 2 in a subsea B.O.P. at the wellhead on the sea floor.

In use of the device as contemplated for protection of a B.O.P. against ingress of deleterious amounts of swarf or debris collected in the circulation fluid, the protector sleeve 2 is made up to the top assembly 3, and running tool housing 4 using threaded connections. The protector sleeve is made from a suitable pipe e.g. 9⅝", or 10¾" casing or similar.

The running tool 5 is shear pinned within the running tool housing 4 and a suitable length of drill pipe is attached to allow handling of the complete B.O.P. protector device assembly.

A work string is made up with attached milling tool or drill bit 30 and deployed in the well bore, and after a suitable length of work string is assembled and run-in hole, the B.O.P. protector device assembly is attached and the string is completed as usual. The B.O.P. protector device is run in hole on the string and landed out at the bottom of the B.O.P. on the wear bushing 7, forming a sealing contact therewith.

The lower annular seal 19 of the B.O.P. is activated to grab and seal off on the protector sleeve 2. Weight is applied through the string to a value calculated to cause yielding of the shear fastener pins 26, thereby freeing the running tool and allowing the work string to be advanced in the wellbore to the site where the milling or drilling operation is to be conducted. As is known in the art for sidetracking purposes, a deflection tool or "whipstock" 31 may be used to direct the milling tool or drill bit into the side of the casing where access is required to the formation. Operation of the tool opens up a window in the casing through which drilling a sidetrack can be achieved.

In this way metal swarf and other deleterious materials generated by the milling/drilling operation are collected in the circulating fluid and pass up through the annulus 12 within the protector sleeve 2 and into the riser 16 and is thus prevented from entering cavities within the B.O.P.

The device of the invention whilst bridging across many of the contingency measures, still allows limited operation of the B.O.P. during a milling operation. If an event occurs which requires use of a contingency measure, the upper annular 18 can be activated to close upon the drill pipe 6 of the work string, or any of the shear rams can be activated.

If there is a need to deliver fluid into the wellbore, whilst the protector sleeve 2 is in position, then by-pass access to the well can be gained by pumping the fluid down the kill line and through the ruptured bursting disc 27.

Once milling operations are completed, the lower annular seal 19 can be opened and the work string pulled, whereupon the running tool 5 again mates with the running tool housing 4 for simple retrieval of the B.O.P. protector sleeve assembly from the well.

In variants of the device, the tubular sleeve 12 is of a shape-retaining material adapted to the purpose of bridging the B.O.P. contingency measures to allow passage of swarf-laden circulation fluid, but is frangible if subjected to transverse loadings e.g. contact from a B.O.P. shear ram closing upon it to allow the ram to close upon and shear the drill pipe. A composite material or ceramic sleeve is suitable for this purpose.

The invention claimed is:

1. A blow-out preventer stack protection device comprising:

a running tool configured to be attached to a downhole work string, said running tool comprising:

a running tool body seperably connected to a running tool housing having a downhole profile shape configured to sealingly engage with a chamfered surface;

a protector sleeve, defining an inner annulus through which the work string runs, associated with the running tool housing, said protector sleeve configured to sealably engage with a blow-out preventer stack seal so as to fluidly isolate a plurality of rams associated with the blow-out preventer stack from the inner annulus; and at least one shearable pin connecting the running tool housing to the running tool body wherein the at least one sharable pin are configured to shear when a predetermined amount of force is applied to the running tool housing.

2. The blow-out preventer stack protection device of claim 1 further comprising a top assembly, including a sealing element, associated with an upper end of the protector sleeve.

3. The blow-out preventer stack protection device of claim 2 wherein the top assembly includes a passage for fluid from the inner annulus to a riser located above the blow-out preventer stack protection device.

4. A method comprising:

deploying a running tool upon a work string into a blow out preventer stack, the running tool comprising:

a running tool body seperably connected to a running tool housing having a downhole profile shape configured to sealingly engage with a chamfered surface;

a protector sleeve, defining an inner annulus through which the work string runs, associated with the running tool housing, said protector sleeve configured to sealably engage with a blow-out preventer stack seal so as to fluidly isolate a plurality of rams associated with the blow-out preventer stack from the inner annulus; and at least one shearable pin connecting the running tool housing to the running tool body wherein the at least one sharable pin are configured to shear when a predetermined force is applied to the running tool housing; and providing fluid down the work string to clear swarf from below the blow out preventer stack.

5. The method of claim 4 further comprising releasing the running tool body from the running tool housing by applying the predetermined force to the running tool housing and shearing the at least one shearable pin.

6. The method of claim 5 further comprising retrieving the running tool by pulling the work string towards the surface so as to contact the running tool housing with the running tool body.

7. The method of claim 4 further comprising providing fluid to outer surface of the protector sleeve and to the plurality of rams via a kill line located above the chamfered surface.

* * * * *